US006773290B2

(12) United States Patent
Lai

(10) Patent No.: US 6,773,290 B2
(45) Date of Patent: Aug. 10, 2004

(54) CONDUCTIVE MEMBER OF ZERO INSERTION/EXTRACTION FORCE INTEGRATED CIRCUIT SOCKET

(76) Inventor: Kuang-Chih Lai, No. 2, Lane 10, Sheng-Li Street, Tu-Cheng City, Taipei Hsien (TW)

( * ) Notice: Subject to any disclaimer, the term of this patent is extended or adjusted under 35 U.S.C. 154(b) by 0 days.

(21) Appl. No.: 10/319,649

(22) Filed: Dec. 16, 2002

(65) Prior Publication Data

US 2004/0009694 A1 Jan. 15, 2004

(30) Foreign Application Priority Data

Jul. 9, 2002 (TW) ..... 91210386 U

(51) Int. Cl.[7] ..... H01R 4/50
(52) U.S. Cl. ..... 439/342
(58) Field of Search ..... 439/342, 885

(56) References Cited

U.S. PATENT DOCUMENTS 4,498,725 A * 2/1985 Bright et al. ..... 439/347
5,299,950 A * 4/1994 Kaneko ..... 439/342
6,319,038 B1 * 11/2001 Howell et al. ..... 439/342
6,478,599 B1 * 11/2002 McHugh et al. ..... 439/342
6,478,637 B1 * 11/2002 Ohkita et al. ..... 439/857
6,554,634 B1 * 4/2003 Lin et al. ..... 439/342

* cited by examiner

*Primary Examiner*—Renee Luebke
*Assistant Examiner*—Ann McCamey
(74) *Attorney, Agent, or Firm*—Rosenberg, Klein & Lee

(57) ABSTRACT

A conductive member of zero insertion/extraction force integrated circuit socket, including: an insertion section inserted in an inlay hole of the insulating seat body; an electrically connecting section extending from one end of the insertion section; and a clamp section connected with the insertion section for contacting with the pin of the integrated circuit. The clamp section has resilient sections, contact sections and bent guide sections. Ones of the contact sections and the guide sections are connected with the resilient ends of the resilient sections, while the others of both sections transversely extend from the ones of the contact sections and the guide sections. The inlay hole is fully sealed by the insertion section, whereby the soldering tin will not infiltrate into the insertion hole of the seat body. The electrically connecting section is 90 degrees bent to form an angle.

6 Claims, 7 Drawing Sheets

CONDUCTIVE MEMBER OF ZERO INSERTION/EXTRACTION FORCE INTEGRATED CIRCUIT SOCKET

BACKGROUND OF THE INVENTION

1. Field of the Invention

The present invention is related to an improvement of U.S. patent application Ser. No. 09/964,559 U.S. Pat. No. 6,488,523, of this applicant.

2. Description of the Prior Art

U.S. patent application Ser. No. 09/964,559 U.S. Pat. No. 6,488,523, of this applicant discloses a zero insertion/extraction force integrated circuit socket 50 including an insulating seat body 51 and multiple conductive members 52. The insulating seat body 51 has multiple insertion holes 53. The distance between each two adjacent insertion holes is defined as an insertion pitch P. The multiple conductive members 52 are cut from the same blank and sequentially side by side arranged on the blank. The distance between each two adjacent conductive members 52 is defined as a distribution pitch Pa. The conductive members 52 are respectively inserted in the insertion holes 53 of the seat body 51 for the pins of an integrated circuit to insert therein.

Each conductive member 52 includes an insertion section 57, an electrically connecting section 58 and a clamp section 59. The insertion section 57 is inserted in the insertion hole 53 and fixed therein. The electrically connecting section 58 extends from one end of the insertion section 57 for electrically connecting with a circuit board. One end of the clamp section 59 is integrally connected with the insertion section 57. The other end of the clamp section 59 extends in a direction distal from the electrically connecting section 58 for the pins of an integrated circuit to insert therein.

The clamp section 59 has at least two resilient sections 60 and at least two contact sections 61. One end of the resilient section 60 is integrally connected with the other end of the insertion section 57. The resilient sections 60 are bent corresponding to each other. Each contact section 61 has a first end 61*a* and a second end 61*b*. The first end 61*a* is integrally connected with the other end of the resilient section 60. The resilient sections 60, contact sections 61 or the resilient sections 60 and contact sections 61 are interlaced and distributed on the blank. The distribution pitch is equal to the insertion pitch. Accordingly, the blank can have maximum utility ratio. Also, the conductive members made of the same blank by punching can be fully inserted into the same row of insertion holes of the insulating seat body at one time.

The two contact sections 61 provide a first slope and a second slope near the insertion section 57. The pin of the integrated circuit is first inserted between the inner side of the insertion section 57 and the two contact sections 61. When the integrated circuit slides toward the contact position, the pin of the integrated circuit is guided by the first and second slopes to slide from the insertion section 57 toward the contact sections 61.

SUMMARY OF THE INVENTION

It is therefore a primary object of the present invention to provide a conductive member of zero insertion/extraction force integrated circuit socket. The clamp section of the conductive member has resilient sections, contact sections and bent guide sections. Ones of the contact sections and the guide sections are integrally connected with the resilient ends of the resilient sections, while the others of the contact sections and the guide sections integrally transversely extend from the ones of the contact sections and the guide sections. The pin of the integrated circuit can be smoothly slided into the space between the two opposite contact sections.

It is a further object of the present invention to provide the above conductive member of the zero insertion/extraction force integrated circuit socket, in which after the insertion section of the conductive member is inserted in the inlay hole, the inlay hole is fully tightly sealed by the insertion section, whereby the soldering tin will not further infiltrate into the insertion hole of the seat body. The electrically connecting section is further 90 degrees bent to form an angle. A small gap is defined between the top face of the bending angle and the bottom face of the periphery of the insertion hole, whereby the soldering tin can enclose the entire electrically connecting section of the conductive member to enhance the soldering effect and increase good product ratio.

It is still a further object of the present invention to provide the above conductive member of the zero insertion/extraction force integrated circuit socket, in which the electrically connecting section integrally extends from one end of the insertion section. The width of the connecting section of the electrically connecting section connecting with the insertion section is smaller than the width of the insertion section, whereby the bending angle can be accurately formed at the connecting section of the electrically connecting section connecting with the insertion section.

It is still a further object of the present invention to provide the above conductive member of the zero insertion/extraction force integrated circuit socket, in which the insertion section further has a projecting section for forcing the electrically connecting section to tightly insert in the insertion hole of the seat body.

The present invention can be best understood through the following description and accompanying drawings wherein:

DETAILED DESCRIPTION OF THE PREFERRED EMBODIMENTS

Figure 1:
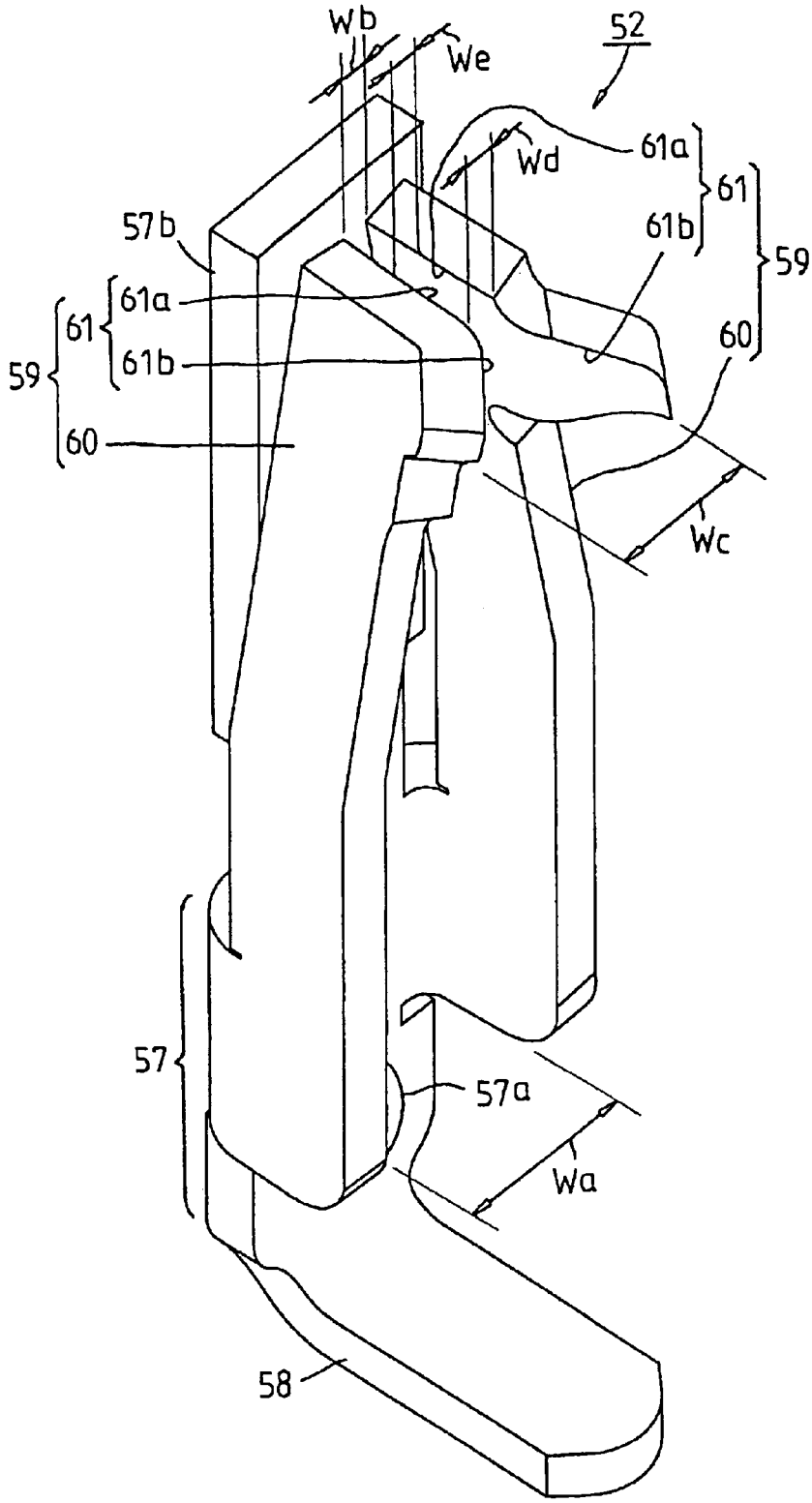
FIG. 1 is a perspective view of the conductive member of a first embodiment of the present invention.
Figure 2:
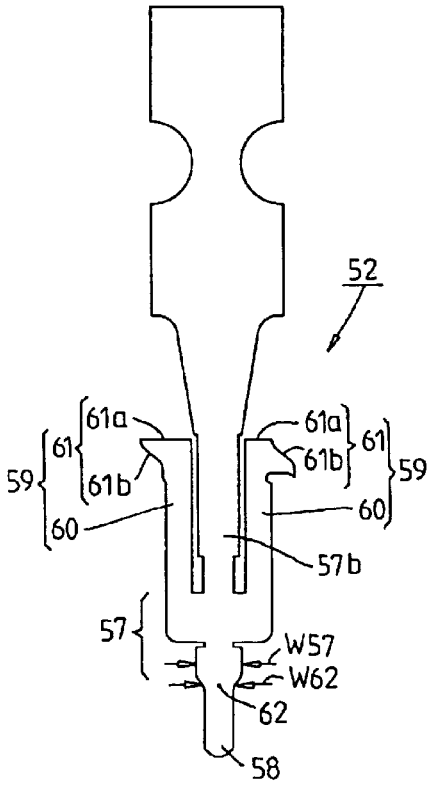
FIG. 2 is a stretched view of one single conductive member of the first embodiment of the present invention.
Figure 3:
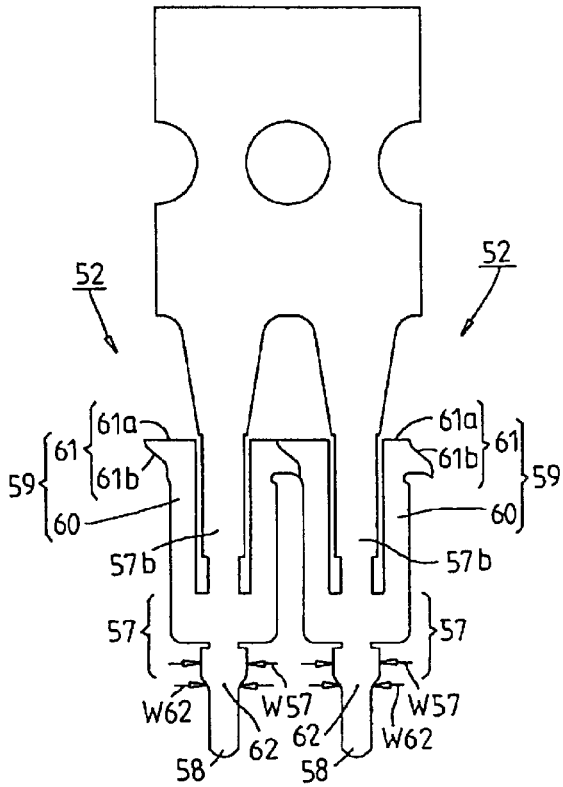
FIG. 3 is a stretched view of two connected conductive members of the first embodiment of the present invention.
Figure 4:
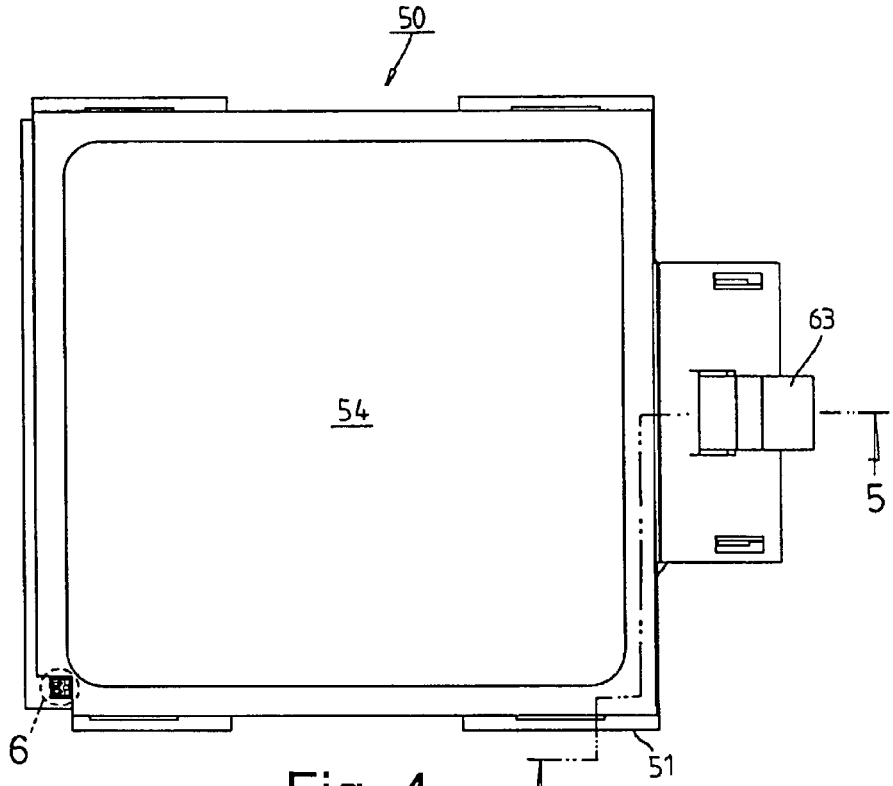
FIG. 4 is a top view of the conductive member of the first embodiment of the present invention, which is inserted into the insulating socket, showing that the pin of the integrated circuit is not yet in contact with the conductive member.
Figure 6:
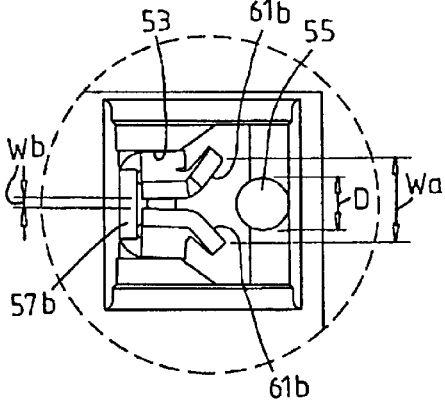
FIG. 6 is an enlarged view of area 6 of FIG. 4.
Figure 5:
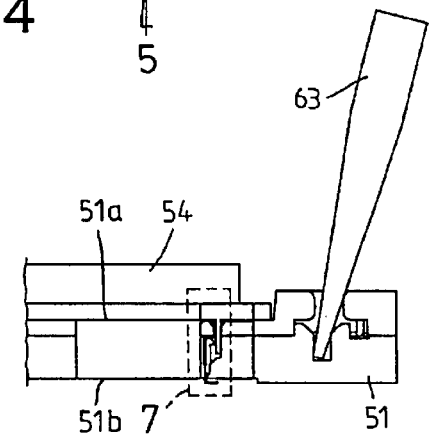
FIG. 5 is a sectional view taken along line 5—5 of FIG. 4.
Figure 7:
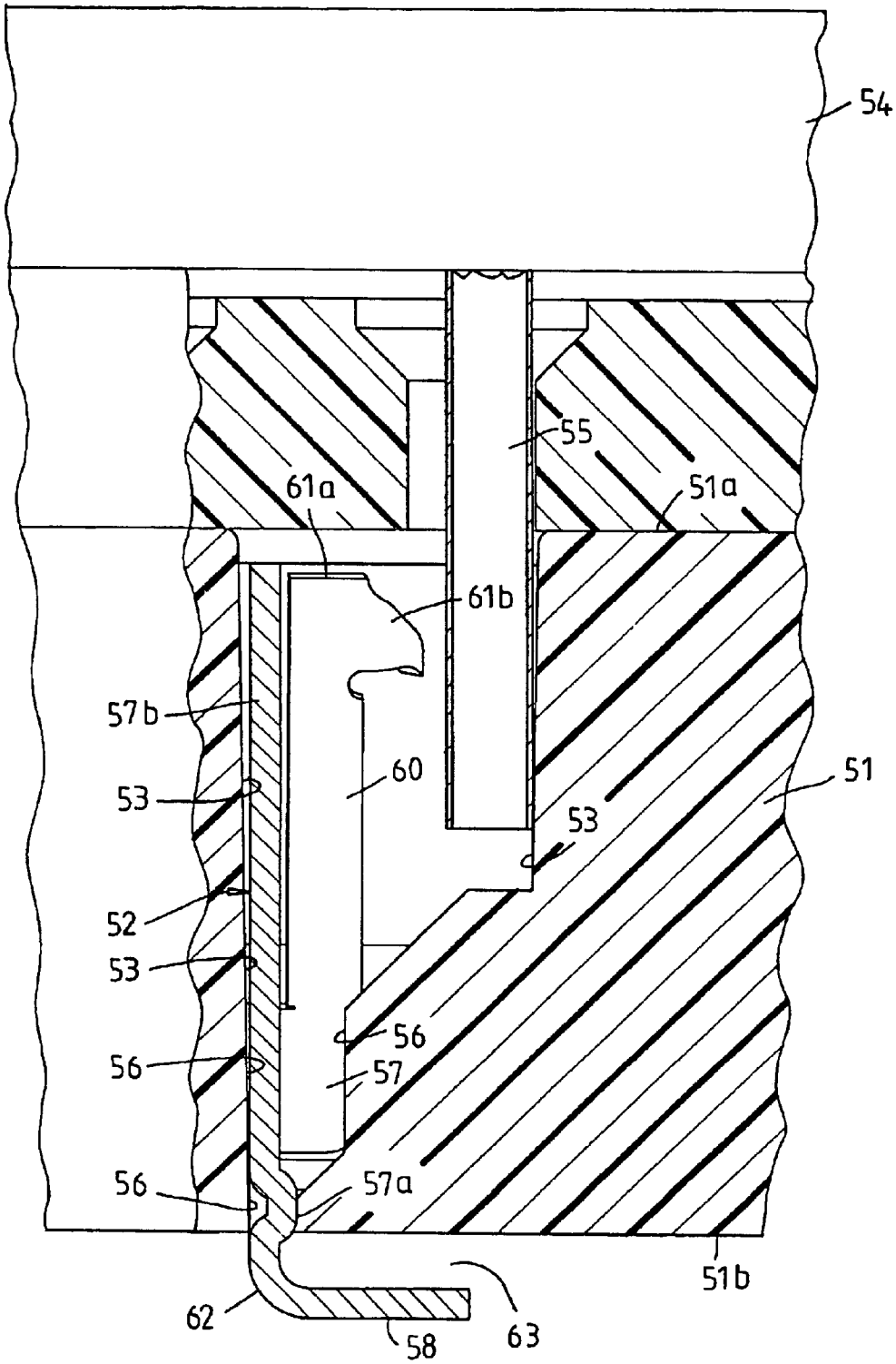
FIG. 7 is an enlarged view of area 7 of FIG. 5.
Figure 8:
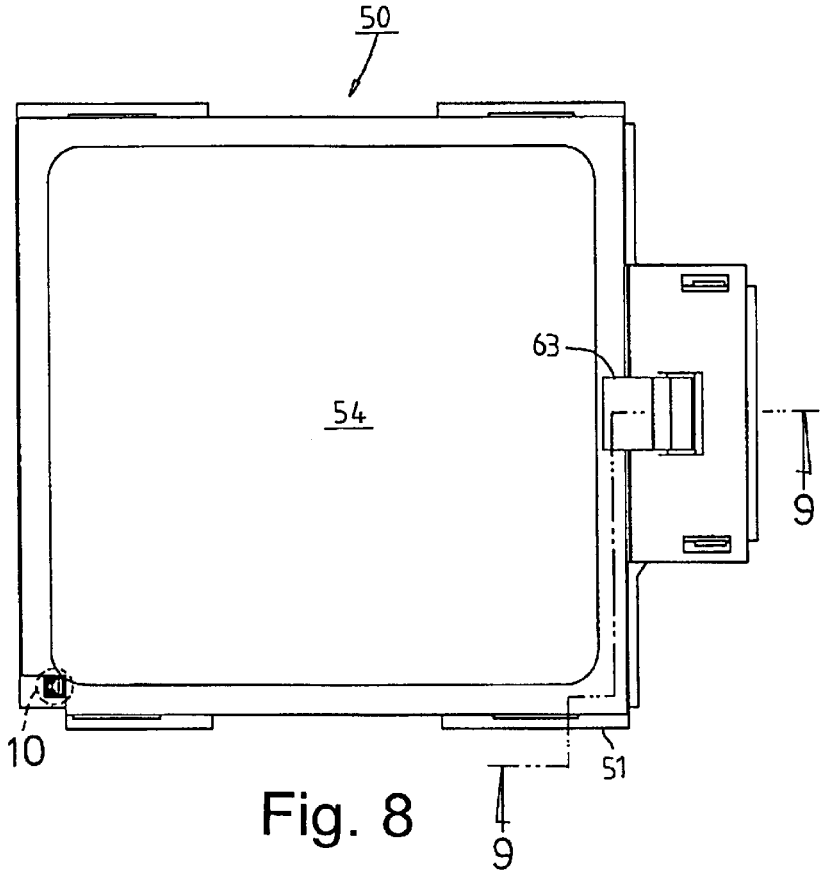
FIG. 8 is a top view of the conductive member of the first embodiment of the present invention, which is inserted into the insulating socket, showing that the pin of the integrated circuit contacts with the conductive member.
Figure 10:
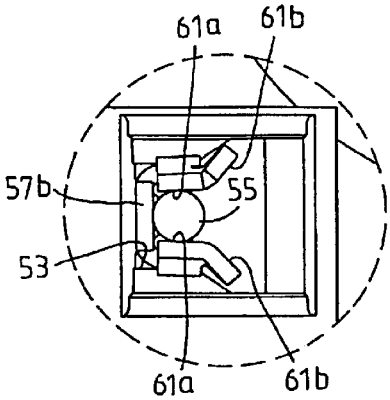
FIG. 10 is an enlarged view of area 10 of FIG. 8.
Figure 9:
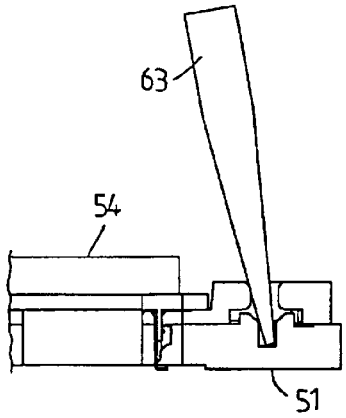
FIG. 9 is a sectional view taken along line 9—9 of FIG. 8.

Please refer to FIGS. 1 to 12. The zero insertion/extraction force integrated circuit socket of the present invention includes an insulating seat body 51 and multiple conductive members 52. The seat body 51 includes: a first face 51*a* adjacent to the circuit board; a second face 51*b* in contact with one face of the integrated circuit 54; multiple insertion holes 53, one end of each insertion hole 53 communicating with the first face 51*a* of the seat body 51; and inlay holes 56 communicating with one end of the insertion hole 53. The other end of the inlay hole 56 communicates with the second face 51*b* of the seat body 51 (referring to FIGS. 5 and 7). The distance between each two adjacent insertion holes is defined as an insertion pitch. The multiple conductive members are cut from the same blank and sequentially side by side arranged on the blank. The distance between each two adjacent conductive members is defined as a distribution pitch. The conductive members are respectively inserted in the insertion holes of the seat body for the pins of the integrated circuit to insert therein.

Referring to FIGS. 1 to 12, each conductive member includes an insertion section 57, an electrically connecting section 58 and a clamp section 59. The insertion section 57 is inserted in the inlay hole 56 of the seat body 51 and fixed therein. The electrically connecting section 58 extends from one end of the insertion section 57 for electrically connecting with the circuit board. One end of the clamp section 59 is integrally connected with the insertion section 57. The other end of the clamp section 59 extends in a direction distal from the electrically connecting section 58. The other end of the clamp section 59 resiliently movably suspends in the insertion hole 53 for the pin 55 of the integrated circuit 54 to insert therein.

The clamp section 59 has at least two resilient sections 60. Each resilient section 60 has a base end and a resilient end. The base end is integrally connected with the other end of the insertion section 57 and longitudinally extends. The resilient sections 60 are bent corresponding to each other.

The clamp section 59 further includes two contact sections 61*a* and two guide sections 61*b*. Ones of the contact sections 61*a* and the guide sections 61*b* are integrally connected with the resilient ends of the resilient sections 60, while the others of the contact sections 61*a* and the guide sections 61*b* integrally transversely extend from the ones of the contact sections 61*a* and the guide sections 61*b*. The resilient sections 60, contact sections 61*a* or the resilient sections 60 and contact sections 61*a* are interlaced and distributed on the blank. The distribution pitch of the blank is equal to the insertion pitch. Accordingly, the blank can have maximum utility ratio. Also, the conductive members made of the same blank by punching can be fully inserted into the same row of insertion holes of the insulating seat body at one time.

Referring to FIGS. 1 to 4, the base ends of the opposite resilient sections 60 define a base end pitch Wa, while the resilient ends of the resilient sections 60 define a resilient end pitch Wb. The base end pitch Wa is larger than the resilient end pitch Wb, that is, Wa>Wb. The two opposite contact sections 61*a* are formed at the resilient ends of the resilient sections 60, while the two opposite guide sections 61*b* respectively transversely extend from the two contact sections 61*a*.

Each guide section 61*b* is bent and has a slope. In addition, the guide sections 61*b* are respectively integrally connected with the two opposite contact sections 61*a*. The guiding ends of the guide sections 61*b* define a guiding pitch Wc. The connecting portions of the guide sections 61*b* respectively connecting with the contact sections 61*a* define a connecting pitch Wd. Before the pin 55 of the integrated circuit 54 slides into the space between the two opposite contact sections 61*a*, a clamping pitch We is defined between the contact sections 61*a*. The clamping pitch We and the connecting pitch Wd are both smaller than the width (or diameter) D of the pin 55 of the integrated circuit 54, that is, We<D and Wd<D. However, the guiding pitch Wc of the guiding ends of the guide sections 61*b* is larger than the width (or diameter) D of the pin 55 of the integrated circuit 54, that is, Wc>D. Therefore, the pin 55 of the integrated circuit 54 can be easily slided into the space between the guiding ends of the opposite guide sections 61*b* and guided by the slopes of the guide sections 61*b* to smoothly slide into the space between the opposite contact sections 61*a*. The pin 55 of the integrated circuit 54 is then clamped by the opposite contact sections 61*a* which originally define a pitch smaller than the width D of the pin 55. Accordingly, an excellent contact effect is achieved.

The insertion section 57 of the conductive member 52 is inserted in the inlay hole 56 to fully tightly seal the inlay hole 56, whereby the soldering tin will not further infiltrate into the insertion hole 53 of the seat body 51. The electrically connecting section 58 is further 90 degrees bent to form an angle, whereby a small gap 63 is defined between the top face of the bending angle and the bottom face of the periphery of the insertion hole 53. Accordingly, the soldering tin can enclose the entire electrically connecting section 58 of the conductive member 52 to increase the good product ratio and achieve better soldering effect.

In order to accurately form the 90 degrees bending angle at the connecting section 62 of the electrically connecting section 58 connecting with the insertion section 57, the electrically connecting section 58 via the connecting section 62 integrally extends from one end (lower end in the figure) of the insertion section 57. The width W62 of the connecting section 62 is smaller than the width W57 of the insertion section 57, that is, W62<W57. Accordingly, the bending angle can be accurately formed at the connecting section 62 of the electrically connecting section 58 connecting with the insertion section 57.

Moreover, the insertion section 57 further has a projecting section 57*a* for forcing the electrically connecting section 58 to tightly insert in the insertion hole 53 of the seat body 51.

The insertion section 57 further has an auxiliary insertion section 57*b* inserted in the insertion hole 53 of the seat body 51 for making the conductive member 52 firmly inserted in the insertion hole 53.

Figure 11:
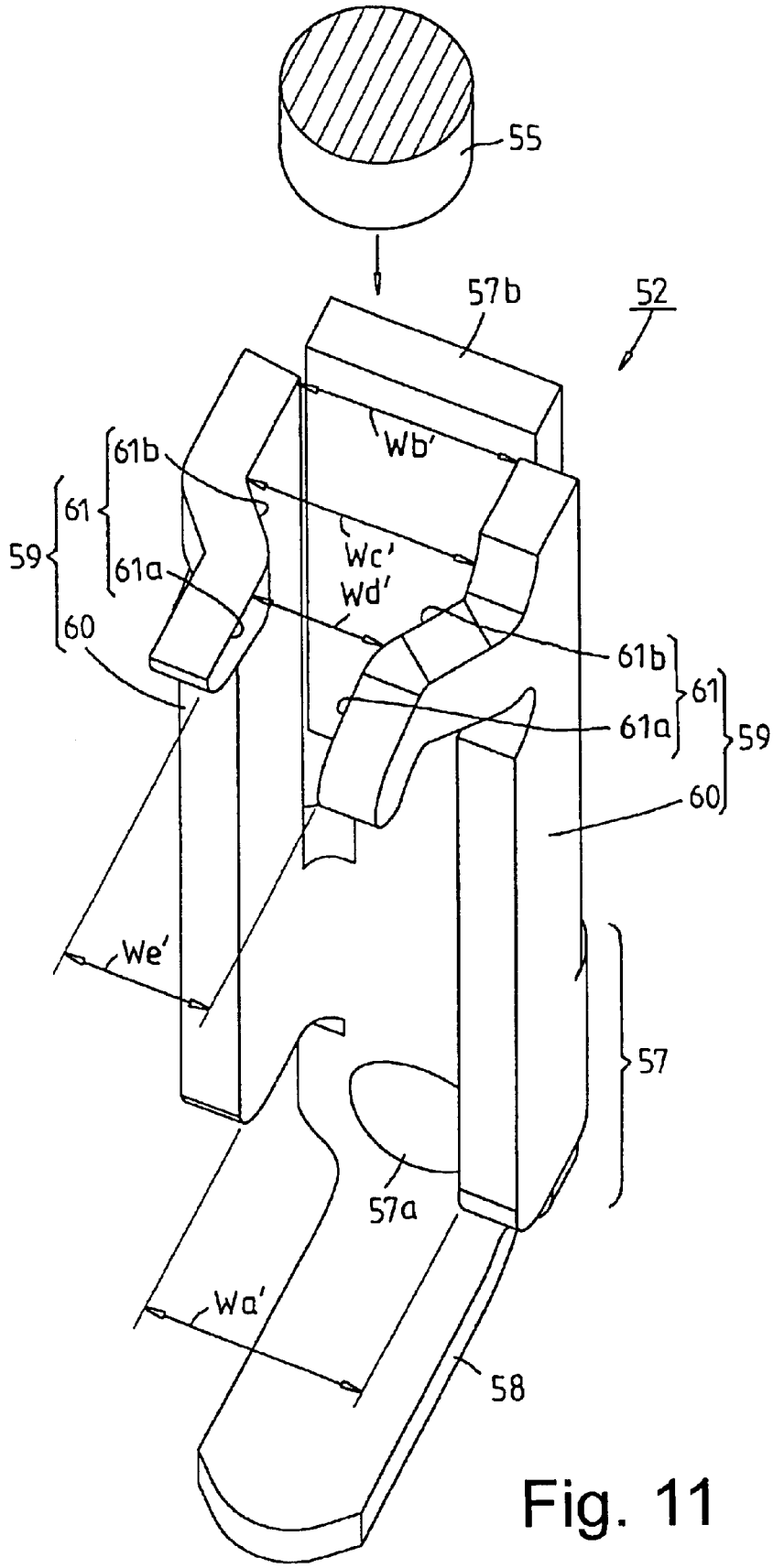
FIG. 11 is a perspective view of the conductive member of a second embodiment of the present invention.
Figure 12:
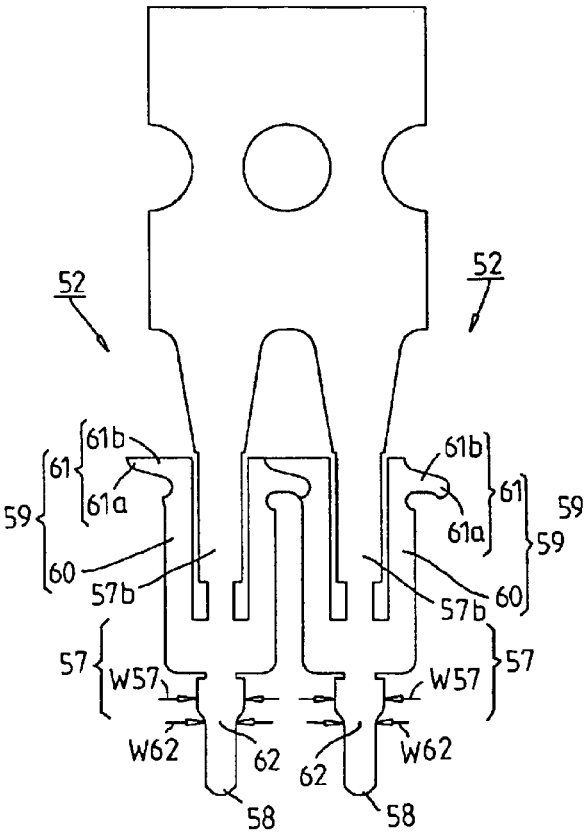
FIG. 12 is a stretched view of two connected conductive members of the second embodiment of the present invention.
Figure 13:
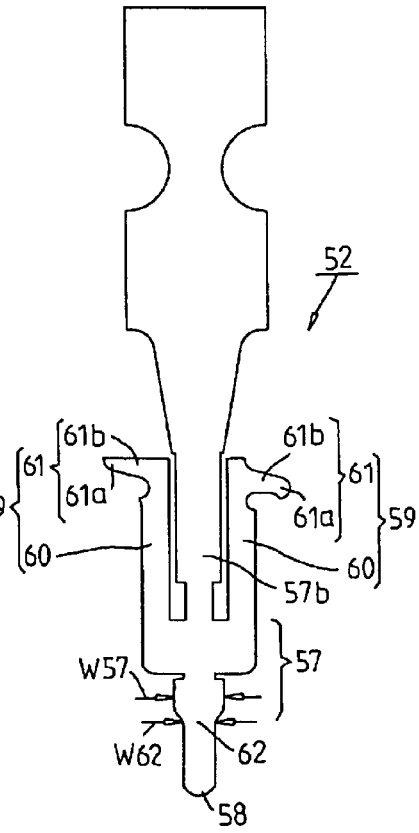
FIG. 13 is a stretched view of one single conductive member of the second embodiment of the present invention.

FIGS. 11 to 13 show a second embodiment of the present invention, in which the base end pitch Wa' between the base ends of the opposite resilient sections 60 is equal to or approximately equal to the resilient end pitch Wb' between the resilient ends of the resilient sections 60, that is, Wa'=Wb'. The two opposite guide sections 61*b* respectively transversely extend from the resilient ends of the resilient sections 60. The two opposite contact sections 61*a* respectively integrally transversely extend from the two opposite guide sections 61*b*.

Each guide section 61*b* is bent and has a slope. In addition, the guiding ends of the guide sections 61*b* define a guiding pitch Wc'. The connecting portions of the guide sections 61*b* respectively connecting with the contact sections 61*a* define a connecting pitch Wd'. Before the pin 55 of the integrated circuit 54 slides into the space between the two opposite contact sections 61*a*, a clamping pitch We' is defined between the two opposite contact sections 61*a*. Before the pin 55 of the integrated circuit 54 slides into the space between the two opposite contact sections 61*a*, the clamping pitch We' and the connecting pitch Wd' are both smaller than the width (or diameter) D of the pin 55 of the integrated circuit 54, that is, We'<D and Wd'<D. However, the guiding pitch Wc' of the guiding ends of the guide sections 61*b* is larger than the width (or diameter) D of the pin 55 of the integrated circuit 54, that is, Wc'>D. Therefore, the pin 55 of the integrated circuit 54 can be easily slided into the space between the guiding ends of the opposite guide sections 61*b* and guided by the slopes of the guide sections 61*b* to smoothly slide into the space between the opposite contact sections 61*a*. The pin 55 of the integrated circuit 54 is then clamped by the opposite contact sections 61*a* which originally define a pitch smaller than the width D of the pin 55. Accordingly, an excellent contact effect is achieved.

The above embodiments are only used to illustrate the present invention, not intended to limit the scope thereof. Many modifications of the above embodiments can be made without departing from the spirit of the present invention.

What is claimed is:

1. A zero insertion/extraction force integrated circuit socket having a plurality of conductive members comprising:

(A) an insulating seat body including: a first face adjacent to a circuit board; a second face in contact with one face of an integrated circuit; multiple insertion holes, one end of each insertion hole communicating with the first face of the seat body; and inlay holes communicating with one end of the insertion hole, an other end of the inlay hole communicating with the second face of the seat body, a distance between each two adjacent insertion holes being defined as an insertion pitch, the plurality of conductive members being cut from a blank and sequentially side by side arranged on the blank, a distance between each two adjacent conductive members being defined as a distribution pitch, the conductive members being respectively inserted in the insertion holes of the seat body for a plurality of pins of the integrated circuit to insert therein; and (B) multiple conductive members cut from said blank and sequentially side by side arranged on the blank, a distance between each two adjacent conductive members being defined as a distribution pitch, the conductive members being respectively inserted in the insertion holes of the seat body for the pins of the integrated circuit to insert therein, each conductive member including:

(a) an insertion section inserted in the inlay hole of the seat body and fixed therein;

(b) an electrically connecting section extending from one end of the insertion section for electrically connecting with the circuit board; and (c) a clamp section, one end of the clamp section being integrally connected with the insertion section, an other end of the clamp section extending in a direction distal from the electrically connecting section, the other end of the clamp section being resilient and being suspended in the insertion hole for the pin of the integrated circuit to insert therein, said other end being movable within said insertion hole the clamp section having:

(1) at least two resilient sections, each resilient section having a base end and a resilient end, the base end being integrally connected with the other end of the insertion section and longitudinally extending, the resilient sections being bent corresponding to each other;

(2) two contact sections; and (3) first and second guide sections, one of the contact sections and a corresponding one of the guide sections being integrally connected with the resilient ends of the resilient sections, while the other of the contact sections and the corresponding one of the guide sections integrally transversely extending from the one of the contact sections and the guide sections, the resilient sections, contact sections being interlaced and distributed on the blank with the distribution pitch equal to the insertion pitch, whereby the conductive members made from said blank by punching can be fully inserted into the same row of insertion holes of the insulating seat body at one time, each guide section being bent and having a slope, the first and second guide sections being respectively integrally connected with the two opposite contact sections, guiding ends of the first and second guide sections defining a guiding pitch, connecting portions of the guide sections respectively connecting with the contact sections defining a connecting pitch, before the pin of the integrated circuit slides into the space between the two opposite contact sections, a clamping pitch being defined between the contact sections, the clamping pitch and the connecting pitch being both smaller than a width of the pin of the integrated circuit, the guiding pitch of the guiding ends of the guide sections being larger than the width of the pin of the integrated circuit, whereby the pin of the integrated circuit can be easily slid into the space between the guiding ends of the opposite guide sections and guided by the slopes of the guide sections to smoothly slide into the space between the opposite contact sections, the pin of the integrated circuit being then clamped by the opposite contact sections which originally define a pitch smaller than the width of the pin to achieve an excellent contact effect, said first guide section of said conductive member engaging said second guide section of an adjacent conductive member in a mating relationship when said conductive members are being formed from said blank.

2. The zero insertion/extraction force integrated circuit socket having a plurality of conductive members as claimed in claim 1, wherein the base ends of the opposite resilient sections define a base end pitch, while the resilient ends of the resilient sections define a resilient end pitch, the base end pitch being larger than the resilient end pitch, the two opposite contact sections being formed at the resilient ends of the resilient sections, while the two opposite guide sections respectively transversely extending from the two contact sections.

3. The zero insertion/extraction force integrated circuit socket having a plurality of conductive members as claimed in claim 1, wherein the base end pitch between the base ends of the opposite resilient sections is equal to the resilient end pitch between the resilient ends of the resilient sections, the two opposite guide sections respectively transversely extending from the resilient ends of the resilient sections, the two opposite contact sections respectively integrally transversely extending from the two opposite guide sections.

4. The zero insertion/extraction force integrated circuit socket having a plurality of conductive members as claimed in any of claim 1 to claim 3, wherein after the insertion section of the conductive member is inserted in the inlay hole, the inlay hole is fully tightly sealed, whereby the soldering tin will not further infiltrate into the insertion hole of the seat body, the electrically connecting section being further 90 degrees bent to form an angle, a small gap being defined between the top face of the bending angle and the bottom face of the periphery of the insertion hole, whereby the soldering tin can enclose the entire electrically connecting section of the conductive member to enhance the soldering effect.

5. The zero insertion/extraction force integrated circuit socket having a plurality of conductive members as claimed in any of claim 1 to claim 3, wherein the electrically connecting section via the connecting section integrally extends from one end of the insertion section, a width of the connecting section of the electrically connecting section connecting with the insertion section being smaller than the width of the insertion section, whereby the bending angle can be accurately formed at the connecting section of the electrically connecting section connecting with the insertion section.

6. The zero insertion/extraction force integrated circuit socket having a plurality of conductive members as claimed in any of claim 1 to claim 3, wherein the insertion section further has a projecting section for forcing the electrically connecting section to tightly insert in the insertion hole of the seat body.

* * * * *